United States Patent [19]

Stone, III

[11] Patent Number: 4,872,221

[45] Date of Patent: Oct. 10, 1989

[54] REENFORCED PANT STRUCTURE

[76] Inventor: Eugene E. Stone, III, 1500 Poinsett Highway, Greenville, S.C. 29608

[21] Appl. No.: 125,803

[22] Filed: Nov. 23, 1987

Related U.S. Application Data

[63] Continuation of Ser. No. 06,857,648, Apr. 29, 1986, abandoned.

[51] Int. Cl.[4] ..... A41B 9/02; A41D 27/24

[52] U.S. Cl. ..... 2/404; 2/275; 112/262.1; 112/419

[58] Field of Search ..... 2/401, 403, 404, 407, 2/275; 112/419, 262.1

[56] References Cited

U.S. PATENT DOCUMENTS

| | | | |
|---|---|---|---|
| 2,231,299 | 2/1941 | Senderowitz | 2/401 |
| 2,651,049 | 9/1953 | Burkhard | 112/419 |
| 2,843,852 | 7/1958 | Stone | 2/401 |
| 3,134,108 | 5/1964 | Terry et al. | 2/404 |
| 3,495,275 | 2/1970 | Terry | 2/404 |
| 3,605,739 | 9/1971 | Beard et al. | 2/403 X |
| 4,190,010 | 2/1980 | Bibby | 112/419 |

*Primary Examiner*—H. Hampton Hunter
*Attorney, Agent, or Firm*—Bailey & Hardaway

[57] ABSTRACT

A pant garment is formed of two front panels connected to each other to form a fly and crotch and connected to a bakc panel to form side seams and an inseam with an improvement in the stitching therein of a reenforcing fabric across said crotch and into an end portion of an inner fly.

2 Claims, 5 Drawing Sheets

REENFORCED PANT STRUCTURE

This application is a continuation of application Ser. No. 06/857,648, filed 04/29/86, now abandoned.

BACKGROUND OF THE INVENTION

This invention relates to garments and in particular to shorts, especially for men and boys, but also adaptable for use by women and analagous structures such as pajamas. A suitable design for a garment such as men's and boy's shorts must satisfy a number of rigid requirements. The garment must not only conform to establish size standards, but also it should be economical to produce and should provide a structure which will withstand the rigors associated with repeated wearings and washings of such structures.

U.S. Pat. No. 3,495,275 describes a conventional short structure but with a weak point inherent therein as will become apparent from a description of the invention herein.

SUMMARY OF THE INVENTION

It is thus an object of this invention to provide an improved construction for pant structures and particularly for boxer undershort construction.

It is a further object of this invention to provide a structure which overcomes a weakness in conventional short structures.

These as well as other objects are accomplished by an improvement to short structures constructed from two front panels connected to each other to form a fly and crotch and connected to a back panel to form side seams and an inseam by providing a reenforcing fabric stitched to the crotch structure and extending into an inner fly of a side panel.

DETAILED DESCRIPTION

In accordance with this invention it has been found that failure of short garments is largely associated with the coming together of the several components, i.e., side panels and rear panels to form a crotch and inseam structure. It has particularly been found that such failure emanate from the crotch structure and progress from that point either toward the fly or through the inseam. It has thus accordingly been found in accordance with this invention that this method of failure is corrected by providing in the structure a reenforcement about the joinder of side panels forming the crotch. The reenforcement of this invention extends through the crotch structure into the end of the fabric forming the inner fly as well as into the inseam thereof. As this structure is largely related to the entire structure of the construction of a pair of shorts, the following description will begin with a description of short construction and at the appropriate point discuss the reenforcing technique of this invention. Various other advantages and features will become apparent from a reading of the following description given with reference to the various figures of drawing.

Figure 1:
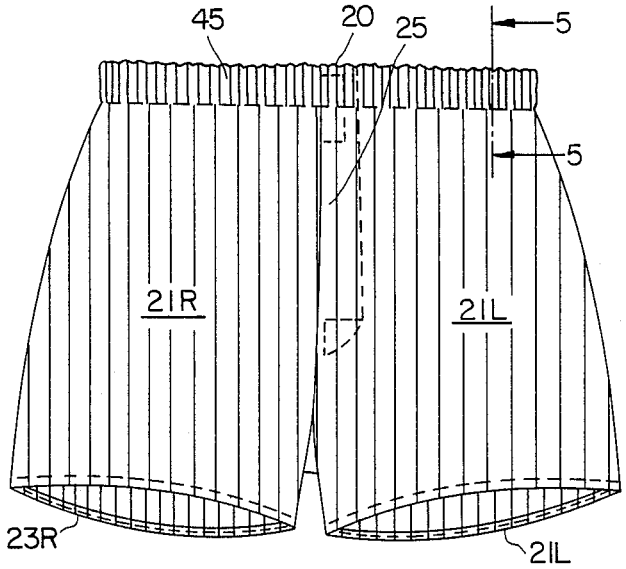
FIG. 1 is a front view of a completed pair of men's and boy's shorts.
Figure 2:
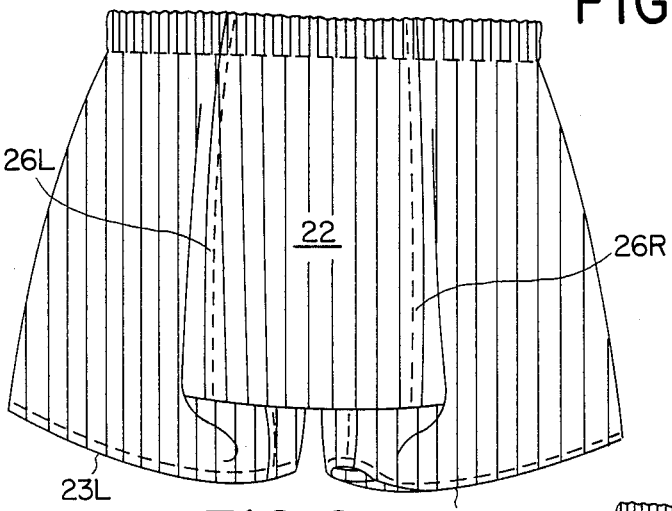
FIG. 2 is a rear view of the shorts illustrated in FIG. 1.
Figure 3:
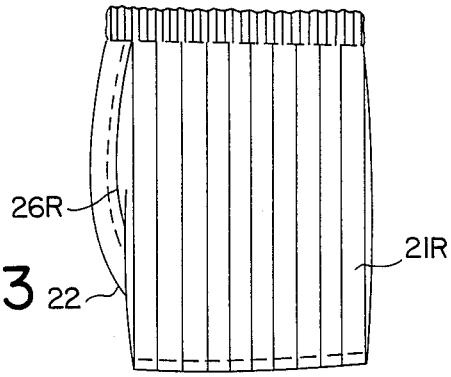
FIG. 3 is a side view of the shorts illustrated in FIG. 1.

Boxer shorts are normally constructed of woven or unribbed knited material and comprises, as shown in FIGS. 1–3, a waist portion 20, a front portion 21 comprising a righthand portion 21R and a lefthand portion 21L, a seat, or back portion 22 and leg portion 23R and 23L. An attractive design is created by using cloth with design lines on the straight of the material and for purposes of this description such a design is employed to more dramatically illustrate the features of the invention. Therefore, in the illustrated embodiment the lines are parallel to the longitudinal direction of the length of material from which the individual panels are taken.

The portions of FIGS. 1 and 2 to the left and right of the break lines respectively illustrate the normal condition of the shorts with the elastic waistband relaxed. The other portions of the shorts of FIGS. 1 and 2 on the other side of the break lines illustrate the shorts with the elastic waistband stretched to the limit permitted by the material.

FIG. 3 illustrates the shorts viewed from the right-hand side. It should be noted that the back panel 22 joins the left front panel 21R at a seam 26L which extends along the portion of the garment which is farthest to the left when the shorts are being worn.

Figure 4:
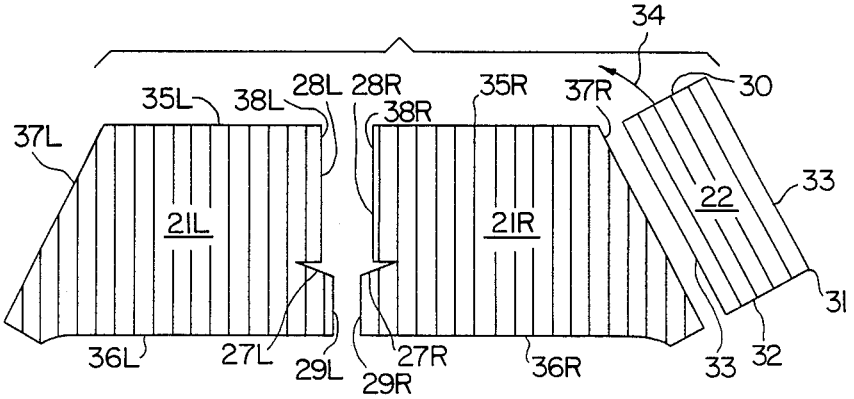
FIG. 4 is a plan view of the blanks required to make the shorts of FIGS. 1–3.

FIG. 4 illustrates the three basic panel blanks necessary to construct the shorts according to the present invention. The design lines shown in FIG. 4 are parallel to the longitudinal axis of the length of material from which the panels were cut. For convenience this axis will be referred to hereinafter as the "material axis." There is provided a back panel 22, a right front panel 21R and a left front panel 21L. The panel 22 includes an upper edge 30 and a lower edge 31, the latter including an upwardly concave central portion 32. The upper edge will constitute a part of the waist 20, the lower portion 32 will constitute the inseam and the remaining portions of the edge 31 will form part of legs 23R and 23L. The panel 22 has two side edges 33.

The two side panels 21R and 21L are identical to each other except that each is reversed, right to left, with respect to the other. These panels are shown in FIG. 4 adjacent to the edges of panel 22 to which they will be attached. Each side panel includes a straight upper edge 35 and a straight lower edge 36 parallel to edge 35. Each panel further includes an outer, or "fly" edge 38 perpendicular to edges 35 and 36 and parallel to the material axis, and an inner, or "side" edge 37. It will be noted that when the panels 21R and 21L are attached to panel 22, the lines 35 and 36 will form linear extensions of the outermost ends of lines 30 and 31, respectively.

To form a pair of shorts with the blanks of FIG. 4, the seams 26R and 26L are first formed by attaching each of the edges 37R and 37L to their adjacent edges 33 of panel 22 (as shown in FIG. 4) by suitable stitching. Edges 35R, L and 36R, L now form linear extensions tangent to the outer ends of upper edge 30, and lower edge 31 respectively.

With the three pieces so joined the two panels 21R and 21L are turned towards each other in the direction of arrow 34 (see FIG. 4) so that edges 38R and 38L come together in the front of the garment to form the fly.

Approximately one-third of the distance up the edges 38 perpendicular slits 27 are made, these slits separating fly edge portions 28 from the inseam edge portions 29. The result should be such that the sum of the lengths of the two inseam edge portions 29R and 29L is slightly larger than the length of portion 32 of the bottom edge of the back panel 22.

Figure 5:
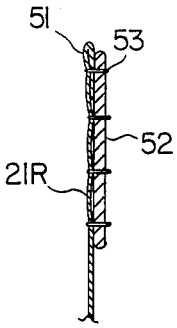
FIG. 5 is a detailed sectional view of the waist taken along line 5—5 of FIG. 1.

After the blank has been attached to form one large blank, and after the slits have been made, it is convenient to attach the elastic waistband 52 (see FIG. 5) by stitching it to the upper portion of the blank along edges 35L, 30 and 35R in a known manner with four lines of stitching as shown at 53 in FIG. 5. The band 52 is, of course, stretched to a certain extent while applying, so that on completion the material at the waist portion 20 will gather, due to the contraction of the band 52. For reasons hereinafter discussed, the waistband 52 is started at about a distance in from the edge 38L which is equal to the depth of the slits 27 in edge 28L. The stopping point of the band 52 near the edges 38R on panel 21R should be equal to about ½ the depth of the slit 27 on the edge 38R.

Thus, it should be observed that attaching the band 52 requires only a single unhampered operation. Furthermore, the sewing threads required for the band will not need to be trimmed and reenforced at the respective waistband ends. This will be apparent from the discussion of the fly construction below.

Figure 6:
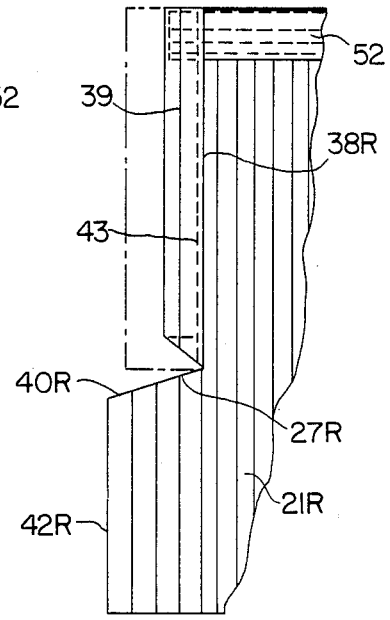
FIG. 6 is a detailed view showing the initial formation of the inner fly end on the reverse of the material.
Figure 7:
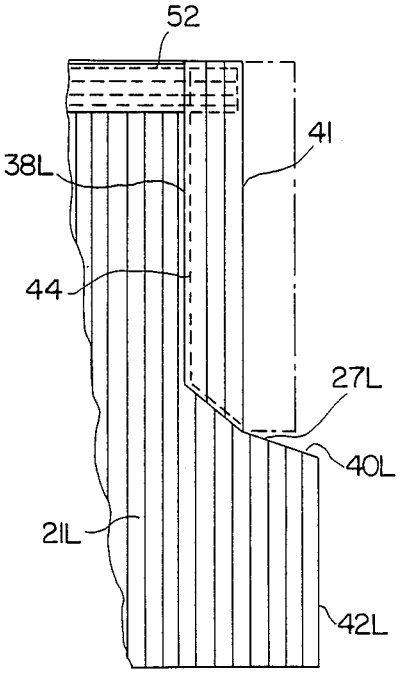
FIG. 7 is a detailed view showing the initial formation of the outer fly end on the reverse of the material.

FIGS. 6 and 7 illustrate the construction of the fly at edges 38R and 38L. FIG. 6 shows a detail of the inner fly construction 39 on panel 21R. This is prepared by folding over edge 38R at a point about ½ the depth of the slit 27R. This is also about at the end of the waistband 52. The extreme edge 38R is then slightly hemmed, and the resulting fold is sewn with a single line stitching 43 the entire length of the edge.

FIG. 7 illustrates the outer fly end portion 41. The edge 38L is folded the entire depth of the slit 27L. This again will also result in a fold at about the end of the band 52. The end is appropriately hemmed and tucked at the lower end such that the stitching 44 of the entire length may result in an angled line as shown.

After the formation of the fly, crotch edges 40L and 40R now become apparent leading to inseam edges 42R and 42L. FIGS. 8 through 14 now illustrate the further construction of the material to form the garment.

Figure 8:
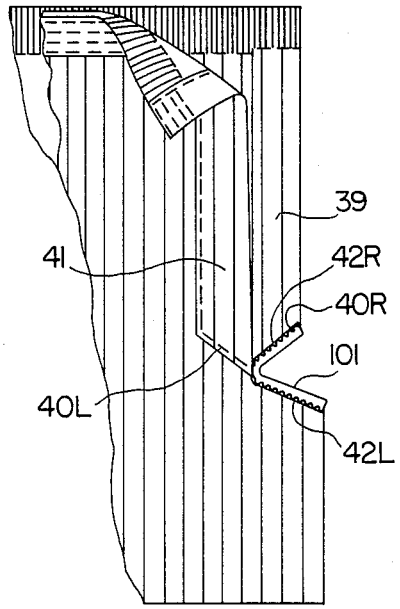
FIG. 8 is a partial front view showing the overlay of the inner and outer fly and crotch in preparation to sewing.
Figure 10:
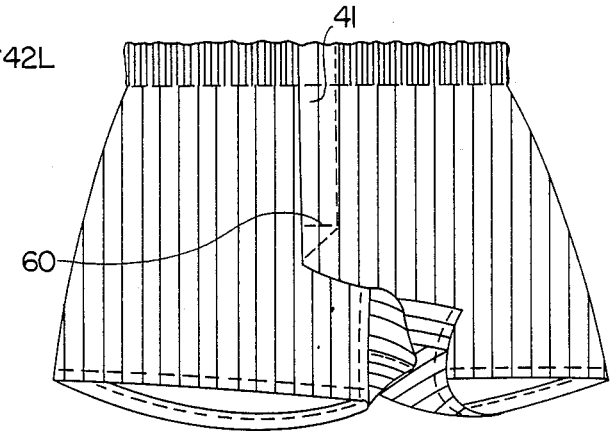
FIG. 10 is an exterior frontal view of the garment illustrating placement of a bartack.
Figure 9:
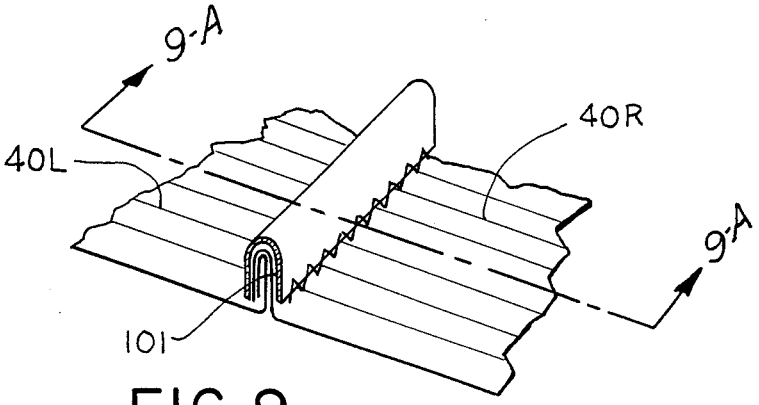
FIG. 9 is a detailed interior view illustrating placement of reenforcement tape of FIG. 8.
Figure 9A:
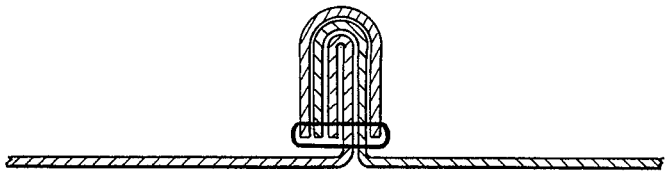
FIG. 9A is a blow-up view along the line 9A—9A of FIG. 9.

FIG. 8 is a view of the reverse side of the garment or interior of the garment. The bottoms of fly 41 and 39 are aligned. Cross edges 40L and 40R are also aligned and folded and placed in a folder with reenforcement tape 101 applied. The reenforcement tape 101 is then sewn to edge 42L and 42R with a zigzag stitch for strength. This is better illustrated in FIG. 9 wherein the folds of 40L and 40R are illustrated as being folded and covered with reenforcement tape 101. It should be noted that this creates a four-ply structure covered by tape 101 to produce a 6-ply structure through which the zig-zag stitching 102 passes. This structure continues from the bottoms of fly 41 and 39 and continues to inseams 42. FIG. 9-A which is a blow-up of a cross-section across the line 9A—9A of FIG. 9 best illustrates the structure described above.

FIG. 10 is again an exterior view of the front portion of the garment which illustrates the application of an "L" shaped bartack 60 through fly 41 and 39 to position the flys and also additionally strengthen the crotch area. It should be noted that the reenforcement tape 101 does not appear on the exterior of the garment.

Figure 11:
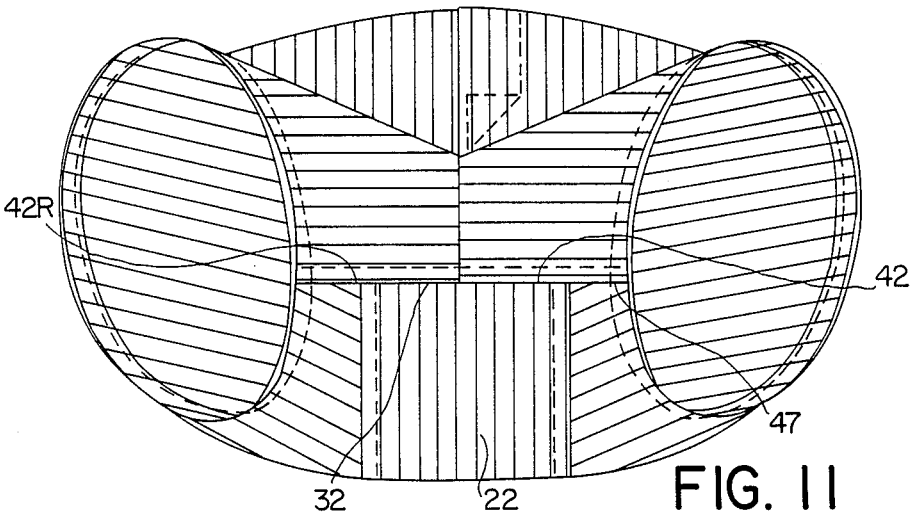
FIG. 11 is a detailed exterior view of the inseam used to form legs in the garment.
Figure 12:
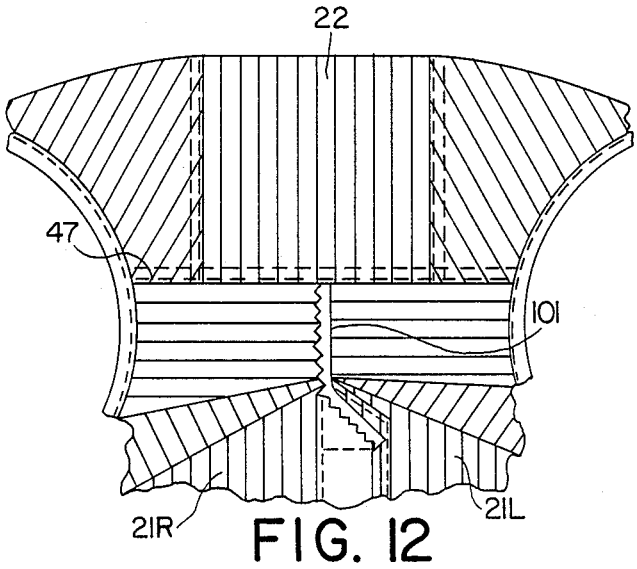
FIG. 12 is an interior view illustrating the inseam of FIG. 11.

FIG. 11 illustrates an exterior view of the formation of leg structures by double needle seam 47 which stitches the front blank inseam edge 42L and 42R to the bottom edge 32 of back panel 22. The interior of the garment is illustrated in FIG. 12 where the double needle stitching 47 is illustrated as tieing into the reenforcement 101 such that the reenforcing tape 101 is tied into the inseam for additional strength.

Figure 13:
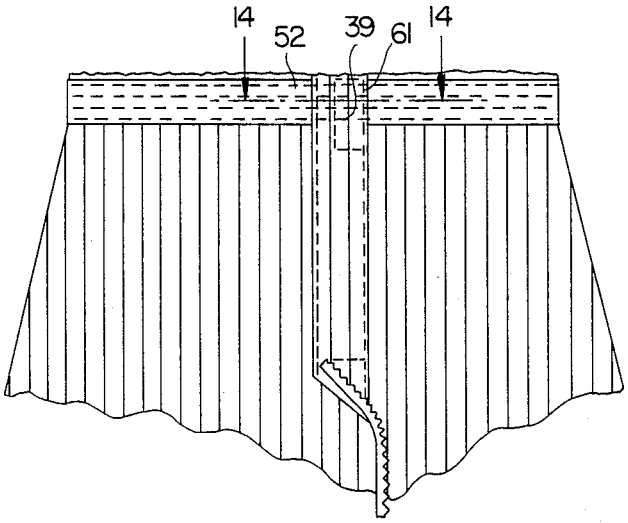
FIG. 13 is an interior view illustrating closement of the waist of the garment.
Figure 14:
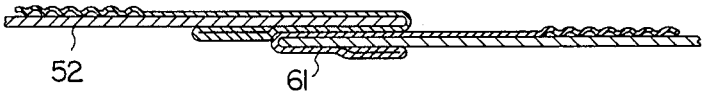
FIG. 14 is a cross-sectional view along the line 14—14 of FIG. 13.

The garment is completed by closing the waist by aligning the tops of the fly 41 and 39 in the area of the waistband 52, FIGS. 13 and 14. A rectangular box is sewn through both flys to form closure 61 as illustrated on the interior of the garment. FIG. 14 is a cross-sectional view along the line 14—14 of FIG. 13 illustrating the closure in the fly area.

It is thus seen that this invention provides a novel pant structure and particularly provides an improvement to a pant structure by reenforcing such structure to eliminate a weak point thereof. As many variations will become apparent from a reading of the foregoing description, such variations are embodied within the spirit and scope of the following appended claims.

What is claimed is:

1. In a pant undergarment including leg portions having two front panels connected to each other to form a fly and crotch and connected to a back panel to form inseams along said leg portions, the improvement comprising forming said crotch by doubly folding over to the same side intersecting and aligned edge portions of said front panels together beneath the inside of the fly, said edge portions co-terminating to form a four ply fold extending from said fly to said inseams, a reinforcing strip of fabric folded over and surrounding both sides of said fold for the full length of said fold, and zigzag stitching extending through said reenforcing fabric and said fold for the full length of said fold.

2. The improvement according to claim 1 wherein said reenforcing fabric is nylon.

* * * * *